United States Patent [19]

Furmanski

[11] Patent Number: 4,590,802

[45] Date of Patent: May 27, 1986

[54] MEASURING APPARATUS FOR MEASURING THE DEGREE OF COMPACTION OF A MATERIAL

[75] Inventor: Walery Furmanski, Lyckeby, Sweden

[73] Assignee: Dynapac AB, Solna, Sweden

[21] Appl. No.: 731,727

[22] Filed: May 8, 1985

[30] Foreign Application Priority Data

May 8, 1984 [SE] Sweden ..... 8402473

[51] Int. Cl.[4] ..... G01M 7/00

[52] U.S. Cl. ..... 73/573; 73/78

[58] Field of Search ..... 73/818, 84, 78, 573, 73/594, 784, 813, 146, 667; 299/1; 404/117

[56] References Cited

U.S. PATENT DOCUMENTS

Re. 31,195 4/1983 Thurner ..... 73/573

3,599,543 8/1971 Kerridge ..... 404/117

*Primary Examiner*—Stewart J. Levy

*Assistant Examiner*—Robert R. Raevis

*Attorney, Agent, or Firm*—Walter Ottesen

[57] ABSTRACT

The invention is directed to a measuring apparatus for determining the degree of compaction of material for building dams, roads or the like after the material has been compacted with a suitable compaction machine. The measuring apparatus includes a vibrating drum which is equipped with a transducer for generating signals while the drum is run over the ground surface for which the degree of compaction is to be determined. In order to eliminate factors which impede evaluation of the signals emanating from the signal transducers, the drum is configured so that its contact surface with the ground surface is as restricted as possible. This can be achieved by reducing the width of the drum.

5 Claims, 3 Drawing Figures

MEASURING APPARATUS FOR MEASURING THE DEGREE OF COMPACTION OF A MATERIAL

FIELD OF THE INVENTION

The invention relates to an apparatus for measuring the degree of compaction of construction material for the building of roads, dams and the like.

BACKGROUND OF THE INVENTION

Heretofore, the results of compaction work have been assessed by means of various methods of measuring the density of the surface, its coefficient of elasticity and the like.

One method that has proven particularly effective for this purpose uses a vibratory roller equipped with at least one vibrating drum. An evaluation is made of the signals received from transducers mounted on the roller as it passes over the ground for which the degree of compaction is to be measured and deviations from the pure sinusoidal form of the signals generated by the transducers constitute a measure of the degree of compaction of the ground. The signals from the transducers after certain processing actuate an indicating instrument mounted on the instrument panel of the roller and enable the operator to read the variations in the signals coming from the transducers directly thereby obtaining a visual indication of the degree of compaction of the ground.

Because the ground is as a rule particularly noncohesive and varying, the reading delivered by the indicating instrument is varying as well. On harder surfaces, the irregularity of drum motion increases because of the relatively long linear contact between the drum and the ground, which as a consequence of this condition increases the variation in the indicator reading. The operator experiences this variation as disturbing and in difficult circumstances it can impair the ability of the operator to read the indicating instrument and thus correctly judge the degree of compaction.

SUMMARY OF THE INVENTION

The invention eliminates, as far as possible, the factors that impede proper assessment of the signals generated by the transducers. As described above, the linear contact with the ground by a cylindrical vibrating drum constitutes a considerable source of disturbance in this context in as much as different parts of the drum in contact with the ground are subjected to fluctuating reaction forces from the ground which, if they are sufficiently strong, induce the drum to vibrate irregularly in the form of rocking oscillations and "double jumps".

The measuring apparatus of the invention avoids this situation by making its contact surface with the ground as restricted as possible.

According to our embodiment of the invention, this condition is achieved by reducing the width of the drum and giving it the shape of a ring. To further limit the contact surface of the ring with the ground, the casing surface of the ring can be configured to have an arcuate profile in a plane passing through the axis of rotation of the ring. The contact surface with the ground of a ring having this profile is concentrated to a point if the ground surface is hard and to a limited elliptical or circular surface for ground surfaces that are more resilient. Under such conditions, the size of the contact surface and its shape are also dependent upon the magnitude of the radius of curvature of the arcuate surface.

Practical tests have shown that for homogeneous material, satisfactory results can also be achieved with a ring-shaped drum having a casing surface which is virtually cylindrical. However, the advantage of a casing surface having an arcuate profile as described above is that it restricts the contact surface to the ground as well as provides a more concentrated penetration of the ground surface when the drum is induced to vibrate.

By replacing the long linear contact surface of a conventional drum with a restricted circular-shaped or linear contact surface, the drum is constantly influenced by reaction forces from the ground which, owing to the limited size of the contact, are relatively equal to each other thereby resulting in considerably smoother readings on the indicating instrument.

The measuring apparatus of the invention is not itself suitable for performing any compaction work. Accordingly, it is used separately and independently of the machine for compacting the ground the degree of compaction of which is to be measured. In this way, the vibration amplitude and frequency of the measuring apparatus can be varied and therefore make it possible to conduct measurements at different depths in the ground. In addition, the frame weight and drum weight of the apparatus of the invention can be varied whereby the measurement process can be easily adapted to the character of the ground permitting a more reliable assessment of the degree of compaction of differing foundations.

BRIEF DESCRIPTION OF THE DRAWING

The invention will now be described with reference to the drawing wherein.

DESCRIPTION OF THE PREFERRED EMBODIMENTS OF THE INVENTION

Figure 1:
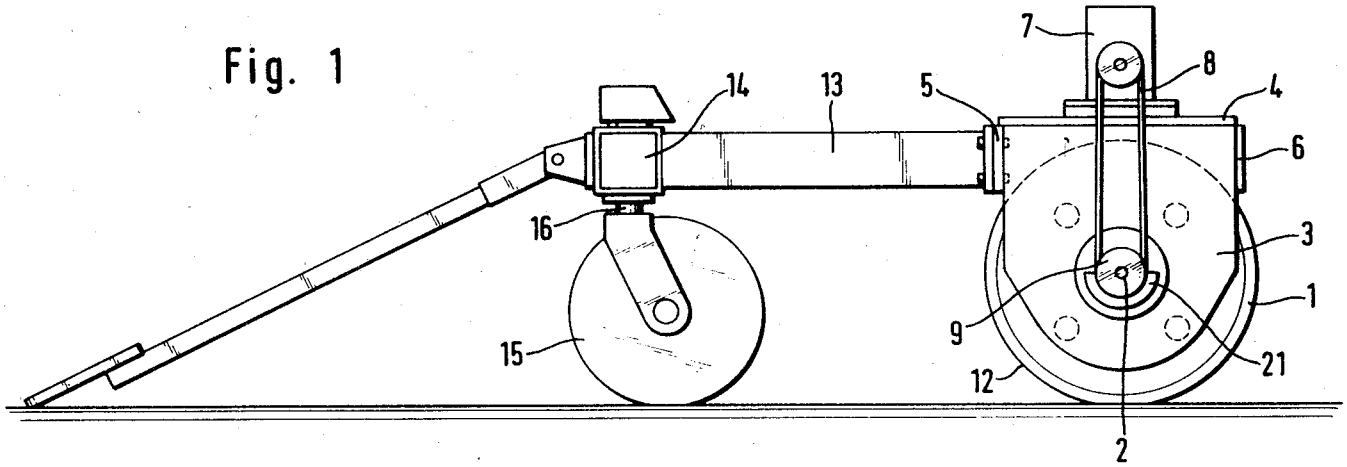
FIG. 1 is a side elevation view of a measuring apparatus according to the invention and includes a ring-shaped drum rotatably journalled in a frame for towing the drum.
Figure 2:
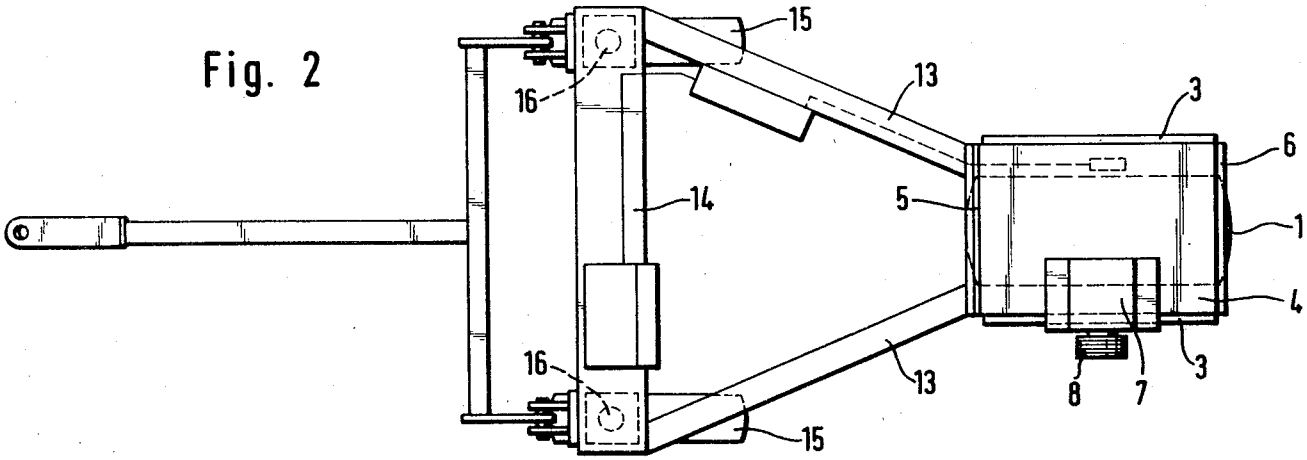
FIG. 2 is a plan view of the measuring apparatus of FIG. 1.

The measuring apparatus according to the invention includes a drum 1 the width of which is greatly reduced in relation to its diameter. A shaft 2 extends through the drum along the axis of rotation thereof and carries an eccentric mass 21. Two vertical plates 3 flexibly carry the shaft 2 on respective sides of the drum and form the sides in a frame 4. The side plates 3 are attached at their upper edges in frame 4. At their front edges, the plates 3 are attached to a forward frame member 5 and, at the rear edges, the plates 3 are attached to a rearward frame member 6. A motor 7 is positioned on the frame 4 and drives the eccentrically-loaded shaft 2 via a V-Belt 8 which applies a drive torque to a V-belt pulley 9 mounted on the shaft 2.

Figure 3:
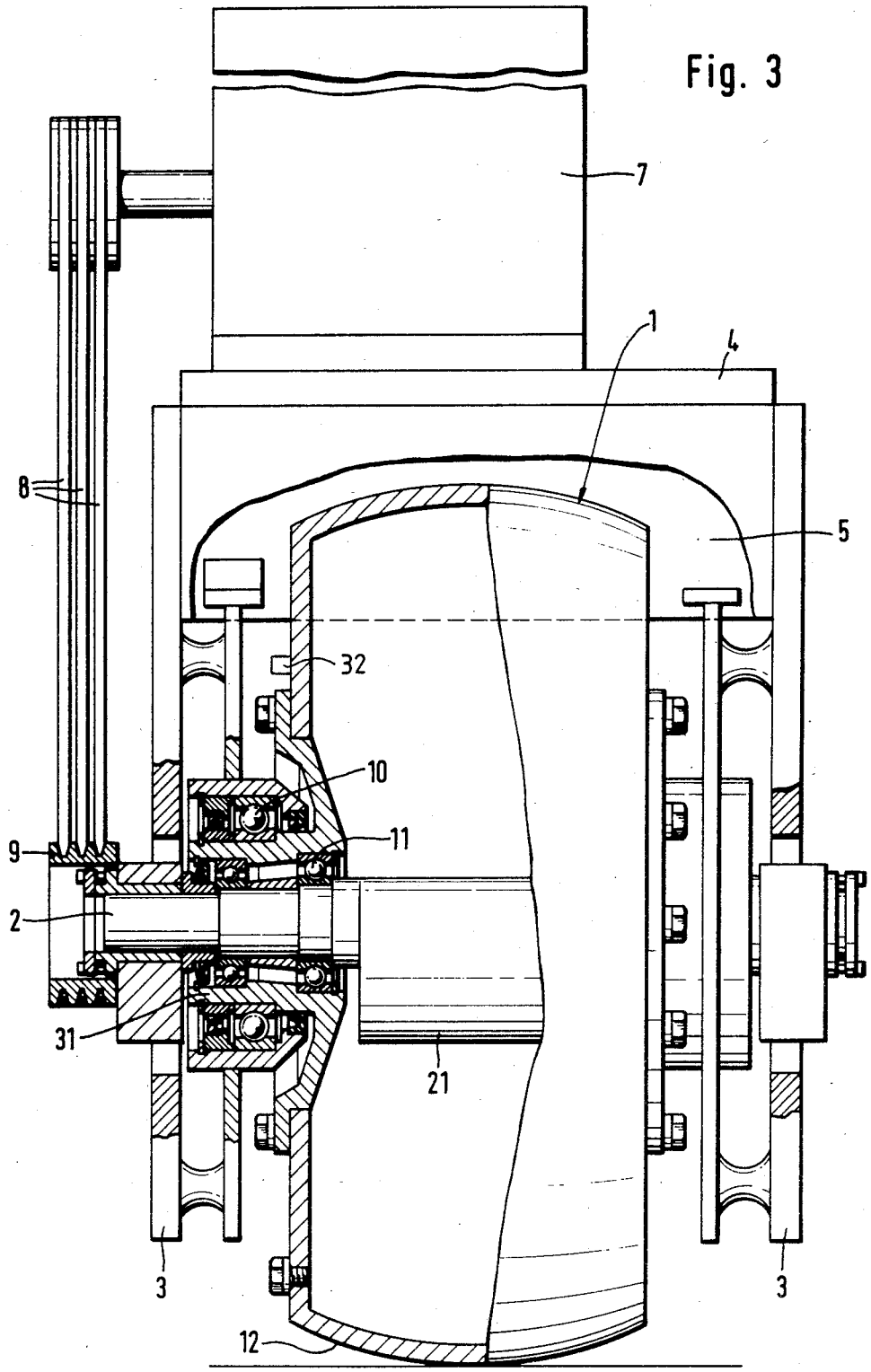
FIG. 3 is an elevation view of the measuring apparatus of the invention with a portion of the frame and drum broken out to show how the drum and eccentrically-loaded shaft are mounted in the frame.

The drum 1 is rotatably journalled in bearing 10 on shaft journals 31 protruding from the ends of the drum as shown in FIG. 3 and shaft 2 is, in turn, rotatably journalled in bearings 11 inside respective shaft journals 31.

For the embodiment disclosed, the casing 12 of the drum 1 is of arcuate cross section so that the contact engagement of the drum with the ground is restricted to a point or circular contact surface depending on the hardness of the ground surface. The arcuate shape of the casing surface of the drum provides the smallest contact surface with the ground. The vibration forces generated by the rotating eccentric shaft 2 are then theoretically concentrated to a point with a concentration corresponding to the reaction forces of the ground. Practical tests show, however, that in certain conditions, good results can also be obtained by means of a cylindrically-shaped casing surface. However, to achieve this, a narrow drum is required.

The embodiment of the measuring apparatus shown is not self-propelled and must be towed by means of a towing bar 13 which can be hooked onto either a separate towing vehicle or on the back of a compaction machine used to perform the compaction work and the compaction capacity of which is to be measured. The towing bar 13 includes two arms which at one end are permanently attached to the forward frame member 5 of the frame 4 and, at the other end thereof, are attached to a front frame 14 carried by two wheels 15. Each of the wheels 15 are articulately journalled in their own vertical shaft 16. The measuring apparatus depicted can be furnished with a towing device adapted for the way it is to be towed.

The measuring apparatus is equipped with a measurement indicator for measuring the degree of compaction of the ground. The measurement indicator arrangement can be of the kind described in Swedish Patent No. 7608709-7 for measuring the degree of compaction of the ground or some other suitable arrangement to serve the same purpose can be utilized.

A vibration action is induced in drum 1 as the measuring apparatus is towed. The signal transducer means 32 is mounted on the drum 1 and transmits signals to a receiving instrument incorporating a read-out device for indicating the degree of compaction in percent or other suitable form.

Because of its special configuration, the contact interface of the drum surface with the ground surface is constantly confined to a point, line or a small elliptical or circular surface. The reading on the read-out device represents the character of the ground surface or degree of compaction under the point or restricted contact interface in question. The reading on the read-out device is therefore not influenced by the character of the ground surface material adjacent the contact interface as is the case with a conventional vibrating roller with a relatively long linear or rectangular contact surface and consequently provides a more definitive and accurate reading. The measuring apparatus according to the invention covers only a limited portion of the entire compacted area in a lateral direction. To compensate for this, two or more measuring apparatus can be towed side by side or their readings can be continually compiled to achieve a mean value.

In the embodiment shown on the drawing, the contact surface of the measurement roller is restricted by reducing the width of the drum and by configuring its casing surface to be arcuate in a plane passing through the rotational axis of the drum. A corresponding reduction of the contact surface can also be achieved if the casing surface on a drum of conventional width is shaped so as to be arcuate in a plane passing through the rotational axis of shaft 2. However, this type of drum is not as cost-effective because such a large portion of the drum is not used for the measuring work.

Other configurations of the measuring drum or roller are possible. For example, a measuring roller of cylindrical shape can be configured to have a reduced containing surface by providing the same with chamfered edges. Also, instead of providing the drum with an arcuate surface, the drum could be configured so as to have a V-shaped cross section.

It is understood that the foregoing description is that of the preferred embodiments of the invention and that various changes and modifications may be made thereto without departing from the spirit and scope of the invention as defined in the appended claims.

What is claimed is:

1. A measuring apparatus for measuring the degree of compaction of the ground or base material used in the building of roads, dams or similar structures, the apparatus comprising:

a chassis frame;

a drum rotatably mounted on said frame and defining a rotational axis about which said drum rotates as the apparatus is pulled over the ground or base material;

eccentrically-loaded shaft means mounted on said frame and mechanically connected to said drum for imparting vibratory movement thereto;

transducer means mounted on said apparatus for generating signals as said drum rolls over the surface of the ground or base material for which the degree of compaction is to be determined; and, said drum having a profile in a plane passing through said rotational axis, said drum being configured so as to cause said profile to have a shape for which the smallest possible portion of said profile is in contact engagement with the ground as said drum rolls thereover thereby permitting the signals delivered by said transducer means to provide an accurate indication of the degree of compaction of the ground or base materkal.

2. The measuring apparatus of claim 1, said drum being configured so as to cause said profile thereof to have a curved shape.

3. The measuring apparatus of claim 1, said drum being configured so as to cause said profile thereof to have a curved shape corresponding to a condition wherein the center of the radius of curvature of said curved shape lies outside of the peripheral surface of said drum.

4. The measuring apparatus of claim 1, said drum being configured so as to cause said profile thereof to have a V-shape.

5. The measuring apparatus of claim 1, said drum being of cylindrical configuration and being further configured so as to cause said profile thereof to have chamfered edges.

* * * * *

UNITED STATES PATENT AND TRADEMARK OFFICE

CERTIFICATE OF CORRECTION

PATENT NO. : 4,590,802

DATED : May 27, 1986

INVENTOR(S) : Walery Furmanski

It is certified that error appears in the above-identified patent and that said Letters Patent is hereby corrected as shown below:

In column 4, lines 11 and 12: delete "containing" and substitute -- contacting -- therefor.

In column 4, line 46: delete "materkal." and substitute -- material. -- therefor.

Signed and Sealed this

*Twelfth* Day of *August 1986*

[SEAL]

*Attest:*

DONALD J. QUIGG

*Attesting Officer*

*Commissioner of Patents and Trademarks*